US005518292A

United States Patent [19]

Cozzani

[11] Patent Number: 5,518,292

[45] Date of Patent: May 21, 1996

[54] FIXING DEVICE FOR A SEAT COVERING

[75] Inventor: Henri Cozzani, Conflans Ste Honorine, France

[73] Assignee: ITW De France, Beauchamp, France

[21] Appl. No.: 148,459

[22] Filed: Nov. 8, 1993

[30] Foreign Application Priority Data

Nov. 12, 1992 [FR] France ..... 92 13601

[51] Int. Cl.[6] ..... A47C 31/02

[52] U.S. Cl. ..... 297/218.5; 297/218.1; 24/301; 24/453

[58] Field of Search ..... 297/218.1, 218.3, 297/218.5, 72.5, 300, 301, 601.2, 614, 615, 453; 267/145, 152, 153

[56] References Cited

U.S. PATENT DOCUMENTS

| | | | |
|---|---|---|---|
| 441,249 | 11/1890 | Magraw | 24/615 |
| 2,589,901 | 3/1952 | Van Doren | 297/218.5 |
| 2,809,692 | 10/1957 | Taffae | 297/218.5 |
| 3,025,104 | 3/1962 | Murphy | 297/218.3 |
| 3,099,058 | 7/1963 | Pettingell | 297/218.5 |
| 3,298,743 | 1/1967 | Albinson et al. | 297/218.5 |
| 3,311,408 | 3/1967 | Sarvas | 297/218.3 |
| 3,981,534 | 9/1976 | Wilton | 297/218.1 |
| 3,995,892 | 12/1976 | Hellman et al. | 297/218.1 |
| 4,789,201 | 12/1988 | Selbert | 297/218.1 |

FOREIGN PATENT DOCUMENTS

| | | |
|---|---|---|
| 0280148 | 8/1988 | European Pat. Off. . |
| 2671704 | 7/1997 | France . |
| 3906200 | 9/1989 | Germany . |

*Primary Examiner*—Richard A. Bertsch
*Assistant Examiner*—William Wicker
*Attorney, Agent, or Firm*—Schwartz & Weinrieb

[57] ABSTRACT

A fixing device (1) for securing a cover (3) to a seat (4) comprises a support (2), and a plurality of elastic fastenings (5) locked in the support (2), wherein the support (2) comprises more locking apertures (8) than the device (1) has elastic fastenings (5). The support (2) is sewn onto the covering (3), the fastenings (5) are locked in the support (2), and after positioning the covering (3) on the seat (4), the hooks (11) of the fastenings (5) are engaged upon components (17) of the seat (4).

20 Claims, 1 Drawing Sheet

Fig.1
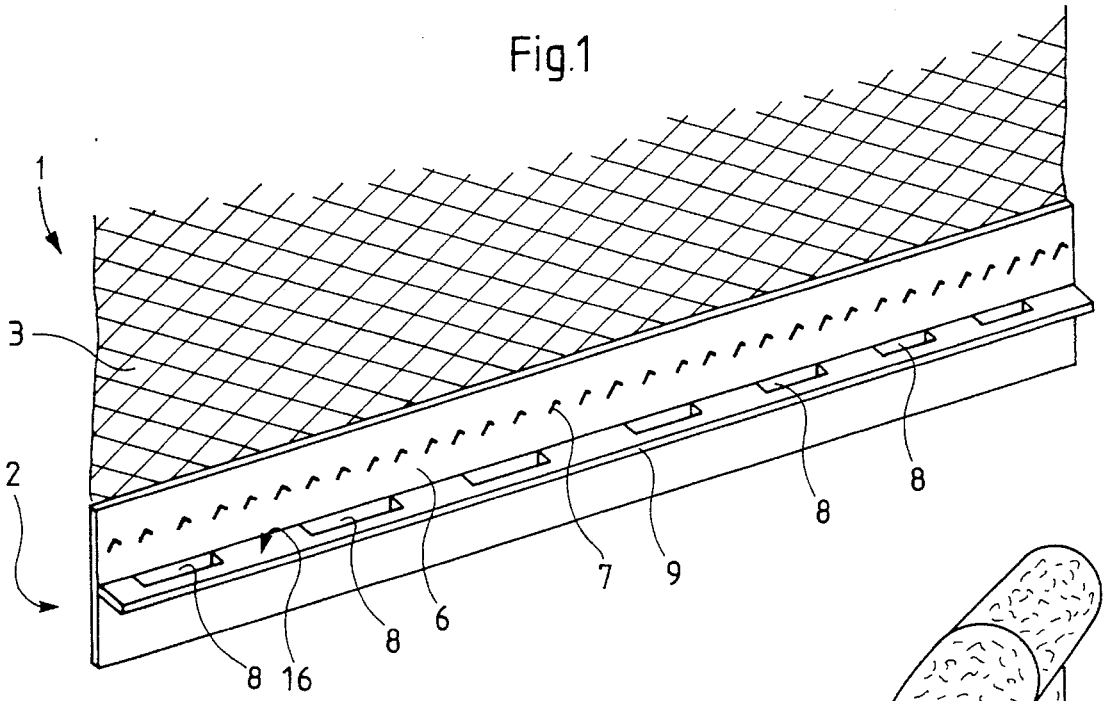
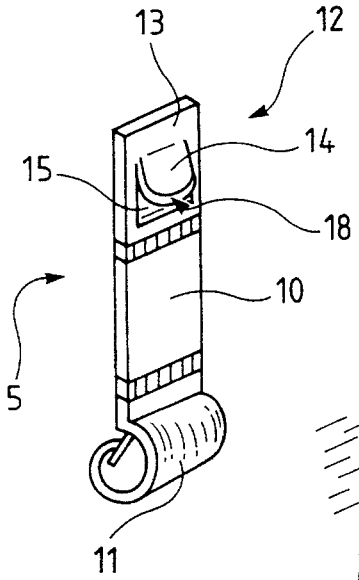
Fig.2
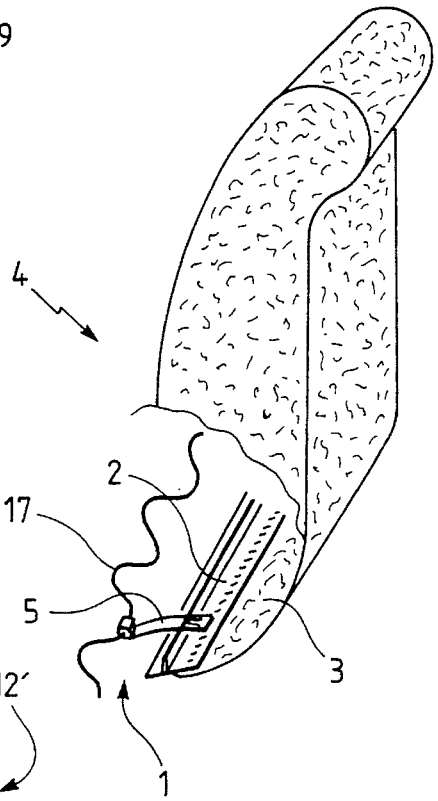
Fig.3
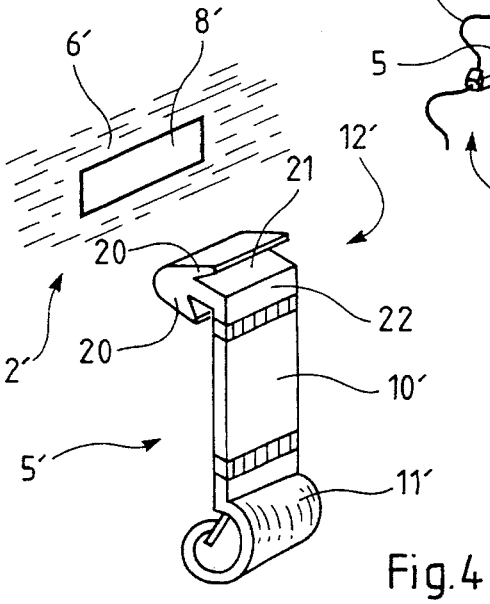
Fig.4

FIXING DEVICE FOR A SEAT COVERING

FIELD OF THE INVENTION

The present invention relates generally to a device for fixing a seat covering upon a seat, and a process for fixing the seat covering upon the seat, in particular a covering for a seat in a motor vehicle, and a seat having such a covering fixed thereon.

BACKGROUND OF THE INVENTION

From French Patent Application 91-00567 there is already known a device for performing an attachment of a seat cover to a vehicle seat, comprising a plurality of preassembled pieces of elastic, each having a hook at a first end, and at a second end, a strip of relatively rigid and thin plastic material adapted to be sewn onto the covering, this seam being the only operation to be performed whereby the attachment is positioned on the covering. The latter is installed on the seat by being disposed upon or over the seat, and then engaging the hooks on a rigid element of the seat, generally one of the springs situated on the underside of the base of the seat.

OBJECT OF THE INVENTION

The object of the invention is, in particular, to provide an attachment of the foregoing type, but which can be suitable for different seats.

SUMMARY OF THE INVENTION

For the foregoing purpose, the present invention embodies a fixing device for a seat covering characterized in that it comprises a support comprising a strip made from a relatively rigid and thin plastic material and adapted to be sewn onto the covering, and a plurality of similar locking apertures defined within the support strip; and a plurality of elastic fastenings wherein each comprises a piece of elastic, a hook mounted on a first end of the piece of elastic and designed to be engaged on a component of the seat, and a locking head mounted on a second end of the piece of elastic, wherein each elastic fastening locking head is adapted to be locked to the support strip by being driven into any one of the locking apertures of the support strip, the fixing device comprising fewer elastic fastenings than the support strip has locking apertures.

The fixing device according to the present invention may be used for seats not having the same configuration because the support strips makes it possible to position the pieces of elastic, which bear a hook at their end, at different locations with respect to the support strip, in view of the fact that the support strip comprises more locking apertures than the device has elastic fastenings. The locations where a fastening is locked are chosen depending upon the sites, of the seat to be covered, where the hooks will be engaged.

The operations to be performed on the covering so as to fasten thereto the fixing device according to the present invention are as simple as those for the above-mentioned previous device in view of the fact that it is only necessary to form a seam. The necessity to undertake the positioning of the elastic fastenings on the support strip at appropriate locations of course requires extra mounting time, but this extra time is minimized by the fact that the mounting is performed by means of a simple locking operation comprising an extremely rapid driving movement or operation, and the corresponding additional cost can be compensated by economics made by avoiding the requirement of providing different fixing devices for different seats.

According to preferred characteristics, the device according to the present invention comprises at least one elastic fastening, the piece of elastic thereof being rigidly mounted on the hook and on the locking head, and the locking head is adapted to be locked to the support strip with a predetermined clearance.

Thus, in such a case, it is not the piece of elastic in and of itself which compensates for the differences in the relative positioning which can exist between the aperture of the support strip where the fastening is locked and the point where the hook engages the seat, but, in addition, it is the clearance between the locking head and the support strip which enables at least some of, and even all, of such positioning differences to be absorbed, so that the piece of elastic essentially or only supports tensile efforts, that is, the conditions are suitable for ensuring its longevity.

In particular, in an embodiment in which the piece of elastic is flat, the predetermined clearance is preferably designed to enable the fastening to pivot with respect to the support strip around an axis at right angles to the general plane of orientation of the piece of elastic.

This pivoting enables the piece of elastic to deform in a homogeneous manner, without being unevenly stretched more upon one side than upon the other side.

In a first embodiment of the invention, which is particularly simple, convenient, and economical, the locking apertures are formed within a rib which protrudes at right angles with respect to the support strip; the locking head comprises a flat member which is an extension of the piece of elastic, and a locking plate, one free end of which, situated on the side where the flat member is attached to the piece of elastic, normally protrudes from the flat member, and which is adapted to bend so that the free end can be retracted into a recess formed within the flat member, so that the locking head can be driven into any one of the locking apertures as a result of the member which passes into the aperture and the plate thereof which encounters a wall of the aperture, whereby the plate bends with the free end thereof being retracted inside the member, whereupon the free end relaxes with the free end facing a support surface of the rib, the free end having a curved periphery whereas the flat member is narrower than the length of the apertures so that the locking head, with the free end of the elastic plate abutting against the support surface, can pivot relative to the support around an axis at right angles to the general plane of orientation of the piece of elastic.

In accordance with a second embodiment of the present invention, the locking apertures are formed directly within the support strip; the locking head is shaped like a ship's anchor having a plane of symmetry at right angles to the general orientation of the piece of elastic with two locking plates situated on both sides of a first bracket which extends at right angles with respect to a second bracket which is attached thereto at a first end, whereas at the opposite end, the second bracket is connected to the piece of elastic, the first bracket not being as thick as the width of the apertures and not being as wide as the length of the apertures, so that the locking head, with the locking plates situated on one side of the support strip, the first bracket situated within the aperture, and the second bracket situated on the other side of the support strip, may pivot with respect to the support strip around an axis at right angles to the general plane of orientation of the piece of elastic.

According to other preferred characteristics, the hook is made from an elastic material, and the locking head and the hook are mounted upon the piece of elastic by means of an overmolding process.

The assembly of the piece of elastic with the hook and with the locking head is thus performed particularly easily, at the same time as the hook and the locking head are manufactured.

It will be noted that in the case in which the previously stated characteristics are present or exhibited, the above-mentioned drawbacks associated with the rigidity of the assembly by overmolding defined between the piece of elastic and the hook on the one hand, and the locking head on the other hand, are avoided.

From a second point of view, the invention relates to a process for manufacturing a seat covering characterized in that a fixing device as previously set forth is used, by sewing the support onto the covering, by locking a predetermined number of the elastic fastenings into the apertures of the support strip, which are chosen according to the seat to be covered, and after positioning the covering on the seat, by engaging the hooks of the elastic fastenings on to appropriate components of the seat.

From a third point of view, the invention relates to a seat, in particular to a seat within a motor vehicle, characterized in that it comprises a seat covering fixed in accordance with the process noted hereinabove.

BRIEF DESCRIPTION OF THE DRAWINGS

The disclosure of the invention will now be provided by the description of two exemplified embodiments, given below as illustrations and not as restrictions, with reference to the attached drawings, in which like reference characters designate like or corresponding parts throughout the several views, and wherein:

FIG. 1 is a diagrammatical perspective view showing a support for a fixing device according to the present invention, and as sewn onto a seating covering;

FIG. 2 is a perspective view of one of the elastic fastenings which forms part of the fixing device of the present invention;

FIG. 3 is a diagrammatical perspective view, partially in cross-section, showing a motor vehicle seat equipped with a covering provided with the fixing device shown in FIGS. 1 and 2; and FIG. 4 is a diagrammatical perspective view showing a second exemplified embodiment of the fixing device of the present invention.

DETAILED DESCRIPTION OF THE ILLUSTRATED EMBODIMENTS

The fixing device 1 shown in FIGS. 1 to 3 comprises a support 2 sewn onto the covering 3 to be fixed to the seat 4, and a plurality of elastic fastenings 5, only one of which is shown in FIG. 3.

As can be seen more precisely in FIG. 1, the support 2 comprises a strip 6 made from a relatively rigid and thin plastic material, such as, for example, polypropylene, having a thickness of 1 mm, by which the support 2 is fastened to the covering 3 by means of a sewn seam 7. The support 2 has a plurality of apertures 8 which are similar, they each have the shape of a rectangular slit, and are provided in a rib 9 protruding at right angles to the support strip 6.

Each elastic fastening 5, as seen in FIG. 2, comprises a flat piece of elastic 10, a hook 11 mounted at a first end of the piece of elastic 10, and a locking head 12 mounted at the other end of the elastic piece 10. The head 12 comprises a flat member 13 which is, effectively, an extension of the piece of elastic 10, and a locking plate 14, the free end of which, situated on the side where the member 13 is attached to the piece of elastic 10, normally protrudes from the member 13, the plate 14 being adapted to bend or flex so that the free end can retract into the recess 15 of the member 13.

The elastic fastening 5 is adapted to be locked to the support 2 by being driven into any one of the apertures 8. More particularly, the upper end of the head 12, as seen in FIG. 2, is introduced into aperture 8 from the lower side thereof, as shown in FIG. 1, the member 13 passes into the aperture 8, the plate 14 encounters a wall of the aperture, the free end of the plate 14 bends or flexes so as to be retracted into the recess 15, and then, the plate 14 relaxes or regains its normal unbent or unflexed position such that the free end comes to lie opposite the upper surface 16 of the rib 9.

In order to fix the covering 3 onto the seat 4, the support 2 is sewn onto the covering 3, and depending upon the seat 4, and more precisely on the positioning of the points on which the hooks 11 will come to be engaged, a choice is made into which apertures 8 the desired number of elastic fastenings 5 are locked, the covering 3 is placed upon the seat 4, and the hooks 11 are engaged onto the components of the seat, such as, for example, a spring 17 shaped like a sinusoid, which is situated on the underside of the base of the seat 4.

The tensioning of the elastic fastening 5 makes the free end of the locking plate 14 come to abut surface 16 of the rib 9.

The fastenings 5 are locked into the support 2 with a certain clearance, which enables, in particular, the fastening 5 to pivot with respect to the support 2 around an axis at right angles to the general plane of orientation of the piece of elastic 10.

This enables the hook 11 to engage a zone of the spring 17 which is not directly aligned with the aperture 8 in which the head 13 is locked, but is slightly offset to the right, or to the left, as shown in FIG. 3, so that the piece of elastic 10 is oriented or deformed in a homogeneous manner and not by being stretched further to the right than to the left, as would have been the case for the fastening 5 shown in FIG. 3 if the mounting between the fastening 5 and the support 2 had been rigid.

In order to enable the fastening 5 to pivot with respect to the support 2, the free end of the locking plate 14 has a curved periphery 18, and the member 13 is narrower than the length of apertures 8; the head 12, with the free end of the plate 14 abutting against the surface 16 of the rib 9, can then pivot as explained, including when the piece of elastic 10 is taut.

The hook 11 and the head 12 are made from molded plastic material, such as, for example, injected polyvinylacetal, and the mounting of the piece of elastic 10 with the head 12 and the hook 11 is achieved by overmolding during the manufacture of the same.

For reasons of simplification, a piece of elastic 10 in the form of a strap has been chosen, the apertures 8 are rectangular slits, and the member 13 has a rectangular shape. The support 2 has a T-shaped section, but it could have been simplified by simply having an L-shaped section.

The locking apertures 8 are regularly distributed along the support 2, but depending upon the circumstances, they could be distributed irregularly, the rib 9 could, for example, have two apertures 8 side-by-side, then there could be an interruption, and then it could continue further on with a group of three apertures 8, or a single aperture, or the like.

In the variant shown in FIG. 4, the same references have been used, but with the addition of a prime index, for similar components. In this second exemplified embodiment, the apertures 8' are formed directly within the strip 6' of the support 2', and the locking head 12' is shaped like a ship's anchor having a plane of symmetry at right angles to the general orientation of the piece of elastic 10'. More precisely, the head 12' comprises two locking plates 20 situated on both sides of a first bracket 21, which is disposed at right angles with respect to a second bracket 22 which is connected thereto at a first end thereof, whereas at the opposite end, the bracket 22 is connected to the piece of elastic 10'.

The bracket 21 has a thickness and width which are less than the corresponding thickness and width of the apertures 8' so that the head 12', with the locking plates 20 situated on the opposite side of the strip 6' to that shown in FIG. 4 such that they are so disposed after driving the head 12' into aperture 8' so as to lock the head 12' in a well known manner to strip 6', with the bracket 21 situated in the aperture 8', and the bracket 22 situated on the side of the strip 6' shown in FIG. 4, may pivot with respect to the support 2' around an axis at right angles with respect to the general plane of orientation of the piece of elastic 10'.

For reasons of simplicity, here the apertures 8' have also been chosen as being rectangular slits, the brackets 21 and 22 are rectangular, and the piece of elastic 10' is also in the form of a strap.

In other variants, which are not shown, the locking apertures, the locking head, the piece of elastic, and the hook have different shapes, selected according to the circumstances.

It is noted that this invention is not restricted to the examples described and illustrated. It is therefore to be understood that within the scope of the appended claims, the present invention may be practiced otherwise than as specifically described herein.

I claim:

1. A system for securing a seat covering to a seat, comprising:

a support comprising a strip made from a plastic material, adapted to be secured to a seat covering, and having a plurality of locking apertures defined therein; and a plurality of substantially planar elastic fastening members each one of said fastening members comprising a hook portion for engaging a component of a seat, a locking head adapted to be movably locked to said support strip by being movably disposed, about an axis perpendicular to the plane of said elastic fastening member, within a respective one of said apertures of said support strip while said locking head is lockingly connected to said support strip so as to accommodate non-alignment dispositions of said component of said seat with one of said apertures, and an elastic member interposed between and fixedly connected to said hook portion and said locking head, at opposite ends thereof, for biasing said hook portion and said locking head toward each other in a tensioned state so as to retain said locking head lockingly engaged with said support strip.

2. The system as set forth in claim 1, wherein:

the number of said plurality of fastening members is less than the number of said plurality of locking apertures.

3. The system as set forth in claim 1, further comprising:

sewn means for securing said support strip to said seat covering.

4. The system as set forth in claim 1, wherein:

said support strip comprises polypropylene.

5. A system according to claim 1, wherein:

said hook portion is made from a plastic material;

said locking head is made from a plastic material; and said locking head and said hook portion are mounted upon said elastic member by means of an overmoulding process.

6. The system as set forth in claim 5, wherein:

said hook portion and said locking head both comprise polyvinylacetal.

7. A system according to claim 1, wherein:

said locking head of each one of said fastening members is adapted to be locked to said support strip with a predetermined amount of clearance so as to permit said movement of said locking head to occur within a respective one of said apertures.

8. A system according to claim 7, wherein:

said elastic member is flat, and said predetermined amount of clearance enables said fastening member to pivot with respect to said support strip around said axis at right angles to said planar orientation of said elastic member.

9. A system according to claim 8, wherein:

said locking apertures are defined within a rib which protrudes at right angles to said support strip and said locking head comprises a flat member which is an extension of said elastic member, and a locking plate, one free end of which, situated on the side of said flat member where said flat member is attached to said elastic member, normally protrudes from said flat member, and which is adapted to flex so that said one free end can be retracted into a recess defined within said flat member so that said locking head can be driven into any one of said locking apertures whereupon said flat member being inserted into said aperture and said locking plate encountering a wall of said aperture, said one free end of said locking plate is retracted inside said recess and then protrudes again such that said one free end engages a support surface of said rib, said one free end having a curved periphery and said flat member is narrower in width than the length of any one of said apertures so that said locking head, with said one free end of said flexible locking plate abutting against said support surface can pivot relative to said support strip and around said axis at right angles to said planar orientation of said elastic member.

10. A system according to claim 9, wherein:

said apertures of said support strip are rectangular slits;

said flat member is rectangular; and said elastic members are in the form of straps.

11. A system according to claim 8, wherein:

said locking apertures are provided within said support strip which is planar; and said locking head having a plane of symmetry disposed at right angles with respect to said planar orientation of said elastic member and having two locking plates disposed upon opposite sides of a first bracket which is disposed at right angles with respect to a second bracket and which is attached to a first end of said second bracket, whereas a second opposite end of said second bracket is connected to said elastic member, said first bracket having a thickness which is less than the depth of said apertures and having a width which is less than the width of said apertures so that said locking head, with said locking plates disposed upon one side of said support strip, said first bracket disposed within one of said apertures, and said second bracket disposed upon the other side of said support strip, may pivot with respect to said support strip around said axis at right angles to said planar orientation of said elastic member.

12. A system according to claim 11, wherein:

said apertures are rectangular slits;

said first and second brackets are rectangular; and said elastic member is in the form of a strap.

13. A system for securing a seat covering to a seat, comprising:

a seat covering;

a support strip secured to said seat covering;

a plurality of apertures defined within said support strip; and a plurality of substantially planar fastening members for interconnecting said support strip, and thereby securing said seat covering, to a seat, each one of said plurality of substantially planar fastening members comprising a first end portion for engaging a component of said seat, a second end portion movably locked to said support strip by being movably disposed, about an axis perpendicular to the plane of said fastening member, within a respective one of said apertures of said support strip while being lockably connected to said support strip so as to accommodate non-alignment dispositions of said component of said seat with one of said apertures of said support strip, and an elastic member interposed between and fixedly connected to said first and second end portions, at opposite ends thereof, for biasing said first and second end portions toward each other in a tensioned state so as to retain said second end portion lockably engaged with said support strip.

14. The system as set forth in claim 13, wherein:

said support strip has a substantially T-shaped configuration comprising a base member substantially coplanar with said seat covering, and a rib member disposed substantially perpendicular to said base member and having said plurality of apertures defined therein; and said second end portion of said fastening member comprises a flat member substantially coplanar with said elastic member; a recess defined within said flat member; and a locking plate, one free end of which, disposed toward said elastic member, normally protrudes from said flat member and is flexibly connected to said flat member at an opposite end thereof so as to be retractable into said recess of said flat member such that when said flat member of said second end portion of said fastening member is inserted into one of said apertures of said rib member of said support strip, said locking plate will encounter a wall of said one of said apertures, said one free end of said locking plate will be retracted into said recess of said flat member, and upon said flat member passing substantially through said one of said apertures, said one free end of said locking plate will again protrude outwardly from said flat member so as to engage a support surface of said rib member of said support strip, said one free end of said locking plate having a curved periphery and said flat member having a width which is less than the width of said one of said apertures so that said second end portion of said fastening member, with said one free end of said flexible locking plate engaged with said support surface of said rib member, can pivot relative to said support strip and around said axis disposed perpendicular to said planar orientation of said fastening member.

15. The system as set forth in claim 13, wherein:

said second end portion of said fastening member has the configuration comprising a plane of symmetry disposed at right angles with respect to said planar orientation of said fastening member and having two locking plates disposed upon opposite sides of a first bracket which is disposed at right angles with respect to a second bracket and which is attached to a first end of said second bracket, whereas a second opposite end of said second bracket is connected to said elastic member, said first bracket having a thickness which is less than the depth of any one of said apertures and having a width which is less than the width of said any one of said apertures so that said second end portion of said fastening member, with said locking plates disposed upon one side of said support strip, said first bracket disposed within said any one of said apertures, and said second bracket disposed upon the other side of said support strip, may pivot with respect to said support strip around said axis at right angles to said planar orientation of said fastening member.

16. The system as set forth in claim 13, wherein: the number of said plurality of fastening members is less than the number of said plurality of locking apertures such that said fastening members can be connected to said support strip at locations which permit connection of said fastening members to said component of said seat.

17. The system as set forth in claim 13, further comprising:

sewn means for securing said support strip to said seat covering.

18. The system as set forth in claim 13, wherein:

said support strip comprises polypropylene.

19. The system as set forth in claim 13, wherein:

said first and second end portions of said fastening members comprise polyvinylacetal.

20. The system as set forth in claim 13, wherein:

said elastic members comprise elastic straps.

* * * * *